US007347278B2

(12) United States Patent
Lerche et al.

(10) Patent No.: US 7,347,278 B2
(45) Date of Patent: Mar. 25, 2008

(54) SECURE ACTIVATION OF A DOWNHOLE DEVICE

(75) Inventors: Nolan C. Lerche, Stafford, TX (US); James E. Brooks, Manvel, TX (US); Choon Fei Wong, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 179 days.

(21) Appl. No.: 10/928,856

(22) Filed: Aug. 27, 2004

(65) Prior Publication Data

US 2005/0045331 A1 Mar. 3, 2005

Related U.S. Application Data

(63) Continuation-in-part of application No. 10/076,993, filed on Feb. 15, 2002, which is a continuation-in-part of application No. 09/997,021, filed on Nov. 28, 2001, now Pat. No. 6,938,689, which is a continuation-in-part of application No. 09/179,507, filed on Oct. 27, 1998, now Pat. No. 6,283,227.

(60) Provisional application No. 60/498,729, filed on Aug. 28, 2003.

(51) Int. Cl.
*E21B 43/116* (2006.01)

(52) U.S. Cl. ..... 175/4.55; 102/215

(58) Field of Classification Search ..... 166/297, 166/66, 250.01, 55.1, 381, 65.1, 72; 175/4.54, 175/4.55; 102/215, 217; 361/249
See application file for complete search history.

(56) References Cited

U.S. PATENT DOCUMENTS

| | | | |
|---|---|---|---|
| 2,655,619 | A | 10/1953 | Neal |
| 3,181,463 | A | 5/1965 | Morgan et al. |
| 3,327,791 | A | 6/1967 | Harrigan, Jr. |
| 3,366,055 | A | 1/1968 | Hollander, Jr. |
| 3,517,758 | A | 6/1970 | Schuster |

(Continued)

FOREIGN PATENT DOCUMENTS

EP 0 029 671 B1 9/1983

(Continued)

OTHER PUBLICATIONS

Lieberman, M. L.; "CP DDT Detonators: II. Output Characterization"; Sandia National Laboratories;, Report SAND: 83-1893C; Albuquerque, New Mexico; pp. 3-17, 1984.

(Continued)

*Primary Examiner*—Sunil Singh
(74) *Attorney, Agent, or Firm*—Trop, Pruner & Hu, P.C.; Kevin Brayton McGoff; Bryan P. Galloway

(57) ABSTRACT

A system includes a well tool for deployment in a well, a controller, and a link coupled between the controller and the well tool. The well tool comprises plural control units, each of the plural control units having a microprocessor and an initiator coupled to the microprocessor. Each microprocessor is adapted to communicate bi-directionally with the controller. The controller is adapted to send a plurality of activation commands to respective microprocessors to activate the respective control units. Each activation command containing a unique identifier corresponding to a respective control unit.

17 Claims, 4 Drawing Sheets

U.S. PATENT DOCUMENTS

| | | | | |
|---|---|---|---|---|
| 3,640,224 | A | 2/1972 | Petrick et al. | |
| 3,640,225 | A | 2/1972 | Carlson et al. | |
| 3,704,749 | A | 12/1972 | Estes et al. | |
| 3,758,731 | A | 9/1973 | Vann et al. | |
| 3,978,791 | A | 9/1976 | Lemley et al. | |
| 4,041,865 | A | 8/1977 | Evans et al. | |
| 4,052,703 | A | 10/1977 | Collins et al. | |
| 4,137,850 | A | 2/1979 | Donner | |
| 4,208,966 | A | 6/1980 | Hart | |
| 4,306,628 | A | 12/1981 | Adams et al. | |
| 4,307,663 | A | 12/1981 | Stonestrom | |
| 4,393,779 | A | 7/1983 | Brede et al. | |
| 4,421,030 | A | 12/1983 | DeKoker | |
| 4,422,381 | A | 12/1983 | Barrett | |
| 4,441,427 | A | 4/1984 | Barrett | |
| 4,471,697 | A | 9/1984 | McCormick et al. | |
| 4,496,010 | A | 1/1985 | Chapman, III | |
| 4,517,497 | A | 5/1985 | Malone | |
| 4,527,636 | A | 7/1985 | Bordon | |
| 4,592,280 | A | 6/1986 | Shores | |
| 4,602,565 | A | 7/1986 | MacDonald et al. | |
| 4,618,197 | A * | 10/1986 | White | 439/76.1 |
| 4,632,034 | A | 12/1986 | Colle, Jr. | |
| 4,638,712 | A | 1/1987 | Chawla et al. | |
| 4,646,640 | A | 3/1987 | Florin et al. | |
| 4,662,281 | A | 5/1987 | Wilhelm et al. | |
| 4,674,047 | A | 6/1987 | Tyler et al. | |
| 4,700,629 | A | 10/1987 | Benson et al. | |
| 4,708,060 | A | 11/1987 | Bickes, Jr. et al. | |
| 4,729,315 | A | 3/1988 | Proffit et al. | |
| 4,735,145 | A | 4/1988 | Johnson et al. | |
| 4,762,067 | A | 8/1988 | Barker et al. | |
| 4,777,878 | A | 10/1988 | Johnson et al. | |
| 4,788,913 | A | 12/1988 | Stroud et al. | |
| 4,831,933 | A | 5/1989 | Nerheim et al. | |
| 4,843,964 | A | 7/1989 | Bickes, Jr. et al. | |
| 4,884,506 | A | 12/1989 | Guerreri | |
| 4,886,126 | A | 12/1989 | Yates, Jr. | |
| 4,944,225 | A | 7/1990 | Barker | |
| 5,014,622 | A | 5/1991 | Jullian | |
| 5,088,413 | A | 2/1992 | Huber et al. | |
| 5,094,166 | A | 3/1992 | Hendley, Jr. | |
| 5,094,167 | A | 3/1992 | Hendley, Jr. | |
| 5,132,904 | A | 7/1992 | Lamp | |
| 5,172,717 | A | 12/1992 | Boyle et al. | |
| 5,295,438 | A | 3/1994 | Hill et al. | |
| 5,347,929 | A | 9/1994 | Lerche et al. | |
| 5,413,045 | A | 5/1995 | Miszewski | |
| 5,505,134 | A | 4/1996 | Brooks et al. | |
| 5,520,114 | A | 5/1996 | Guimard et al. | |
| 5,539,636 | A | 7/1996 | Marsh et al. | |
| 5,579,283 | A | 11/1996 | Owens et al. | |
| 5,706,892 | A | 1/1998 | Aeschbacher, Jr. et al. | |
| 5,756,926 | A | 5/1998 | Bonbrake et al. | |
| 6,032,739 | A | 3/2000 | Newman | |
| 6,092,724 | A | 7/2000 | Bouthillier et al. | |
| 6,173,651 | B1 | 1/2001 | Pathe et al. | |
| 6,283,227 | B1 | 9/2001 | Lerche et al. | |
| 6,536,798 | B1 | 3/2003 | Hamilton | |
| 6,604,584 | B2 | 8/2003 | Lerche et al. | |
| 6,727,828 | B1 | 4/2004 | Malone et al. | |
| 6,752,083 | B1 | 6/2004 | Lerche et al. | |
| 6,843,119 | B2 * | 1/2005 | Patey et al. | 73/152.18 |
| 2001/0040030 | A1 | 11/2001 | Lerche et al. | |
| 2002/0062991 | A1 | 5/2002 | Farrant et al. | |
| 2002/0088620 | A1 | 7/2002 | Lerche et al. | |

FOREIGN PATENT DOCUMENTS

| | | | |
|---|---|---|---|
| EP | 0386860 | B1 | 12/1993 |
| EP | 0 601 880 | A2 | 6/1994 |
| EP | 0604694 | A1 | 7/1994 |
| GB | 677824 | | 8/1952 |
| GB | 693164 | | 6/1953 |
| GB | 1555390 | A | 11/1979 |
| GB | 2100395 | A | 12/1982 |
| GB | 2118282 | A | 10/1983 |
| GB | 2190730 | A | 11/1987 |
| GB | 2226872 | A | 7/1990 |
| GB | 2265209 | A | 9/1993 |
| GB | 2290855 | A | 1/1996 |
| GB | 2352261 | A | 1/2001 |
| GB | 2366817 | A | 3/2002 |
| SU | 1265672 | | 10/1986 |
| WO | WO 95/19489 | A1 | 7/1995 |
| WO | WO 96/23195 | A1 | 8/1996 |
| WO | WO 97/45696 | A1 | 12/1997 |
| WO | WO 98/38470 | A1 | 9/1998 |
| WO | 00/20820 | A2 | 4/2000 |
| WO | WO02/061461 | A2 | 8/2002 |

OTHER PUBLICATIONS

Dineger, R.H.; "High-Temperature-Stable Detonators"; 12th Symposium on Explosives and Pyrotechnics, San Diego, California, Mar. 13-15, 1984; Los Alamos National Laboratory; pp. 4-1 through 4-4.

Lindemuth, I. R.; Brownell, J.H.; Greene, A.E.; Nickel, G.H.; Oliphant, T.A.; and Weiss, D.L. with the Thermonuclear Applications Group, Applied Theoretical Physics Division and Hemsing, W.F. and Garcia, I.A. with the Detonation Systems Group, Dynamic Testing Division; "Exploding Metallic Foils for Slapper, Fuse, and Hot Plasma Applications: Computational Predictions, Experimental Observations"; Los Alamos National Laboratory, Los Alamos, New Mexico, pp. 299-305, undated.

Stroud, J.R.; "A New Kind of Detonator—The Slapper"; Paper prepared for the Annual Meeting of the Fuze Section, Ammunition Technology Division, American Defense preparedness Association, Feb. 27, 1976; Lawrence Livermore Laboratory, University of California, Livermore, California, pp. 1 through 10.

"New Developments in the Field of Firing Techniques" by K. Ziegler Propellants, Explosives, Pyrotechnics 12, 115-120 (1987).

"Application of Slapper Detonator Technology to the Design of Special Detonation Systems," by W. H. Meyers Proc. 12.sup.th Symposium on Explosives and Pyrotechnics, San Diego, California, Mar. 13-15, 1984, Detonation Systems Development, Franklin Research Center Div, Philadelphia PA00, pp. 4-5 through 4-19.

"Flyer Plate Motion and Its Deformation During Flight," by H. S. Yadav and N. K. Gupta Int. J. Impact Engng, vol. 7, No. 1, 1988, pp. 71-83.

"Mossbauer Study of Shock-Induced Effects in the Ordered Alloy Fe.sub.50 Ni.sub.50 In Meteorites," By R. B. Scorzelli, I. S. Azevedo, J. Danon and Marc A. Meyers J. Phys. F: Met. Phys. 17 (1987), pp. 1993-1997.

"Effect of Shock-Stres Duration on the Residual Structure and Hardness of Nickel, Chromel, and Inconel," by L. E. Murr and Jong-Yuh Huang Materials Science and Engineering, 19 (1975), pp. 115-122. Critical Energy Criterion for the Shock Initiation of Explosives by Projectile Impact, by H. R. James Propellants, Explosives, Pyrotechnics 13, (1988), pp. 35-41.

"A Low-Energy Flying Plate Detonator," by A. K. Jacobson Sandia National Laboratories Report, SAND 81-0487C, Albuquerque, New Mexico, 1981, pp. 49-1 through 49-20.

"Sequential Perforations in Boreholes," by H. Lechen ANTARES Datensysteme GmbH, Jan. 1998.

"A Simple Method for Estimating Well Productivity," by J. E. Brooks. SPE European Formation Damage Conference, The Hague, The Netherlands, Jun. 2-3, 1997.

Translation of Russian Official Action from counterpart application, pp. 1-7, dated Mar. 27, 2006 (citing SU 1265672).

* cited by examiner

SECURE ACTIVATION OF A DOWNHOLE DEVICE

CROSS-REFERENCE TO RELATED APPLICATIONS

This is a continuation-in-part of U.S. Ser. No. 10/076,993, filed Feb. 15, 2002, which is a continuation-in-part of U.S. Ser. No. 09/997,021, filed Nov. 28, 2001, now U.S. Pat. No. 6,938,689, which is a continuation-in-part of U.S. Ser. No. 09/179,507, filed Oct. 27, 1998, now U.S. Pat. No. 6,283, 227.

This application also claims the benefit under 35 U.S.C. § 119(e) of U.S. Provisional Application Ser. No. 60/498, 729, entitled, "Firing System for Downhole Devices," filed Aug. 28, 2003.

Each of the referenced applications is hereby incorporated by reference.

TECHNICAL FIELD

The invention relates generally to secure activation of well tools.

BACKGROUND

Many different types of operations can be performed in a wellbore. Examples of such operations include firing guns to create perforations, setting packers, opening and closing valves, collecting measurements made by sensors, and so forth. In a typical well operation, a tool is run into a wellbore to a desired depth, with the tool being activated thereafter by some mechanism, e.g., hydraulic pressure activation, electrical activation, mechanical activation, and so forth.

In some cases, activation of downhole tools creates safety concerns. This is especially true for tools that include explosive devices, such as perforating tools. To avoid accidental detonation of explosive devices in such tools, the tools are typically transferred to the well site in an unarmed condition, with the arming performed at the well site. Also, there are safety precautions taken at the well site to ensure that the explosive devices are not detonated prematurely.

Another safety concern that exists at a well site is the use of wireless devices, especially radio frequency (RF), devices, which may inadvertently activate certain types of explosive devices. As a result, wireless devices are usually not allowed at a well site, thereby limiting communications options that are available to well operators. Yet another concern associated with using explosive devices at a well site is the presence of stray voltages that may inadvertently detonate explosive devices.

A further safety concern with explosive devices is that they may fall into the wrong hands. Such explosive devices pose great danger to persons who do not know how to handle the explosive devices or who want to maliciously use the explosive devices to harm others.

SUMMARY OF THE INVENTION

In general, methods and apparatus provide more secure communications with well tools. For example, a system includes a well tool for deployment in a well, a controller, and a link coupled between the controller and the well tool. The well tool includes plural control units, each of the plural control units having a microprocessor and an initiator coupled to the microprocessor. Each microprocessor is adapted to communicate bi-directionally with the controller.

The controller is adapted to send a plurality of activation commands to respective microprocessors to activate the respective control units. Each activation command contains a unique identifier corresponding to a respective control unit.

Other or alternative features will become apparent from the following description, from the drawings, and from the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
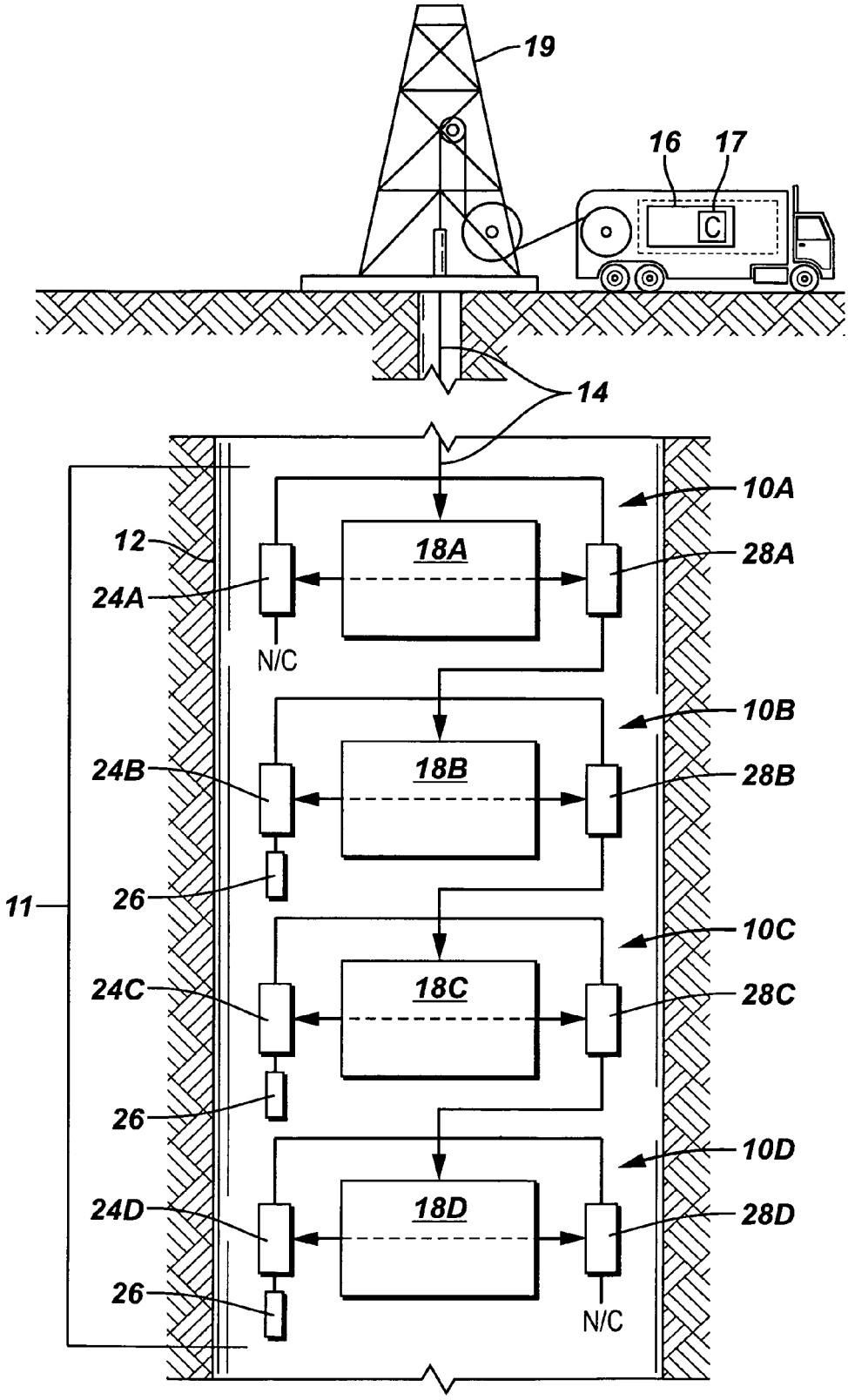
FIG. 1 is a block diagram of an example arrangement of a surface unit and a downhole well tool that incorporates an embodiment of the invention.

Referring to FIG. 1, a system according to one embodiment includes a surface unit 16 that is coupled by cable 14 (e.g., a wireline) to a tool 11. The cable 14 includes one or more electrical conductor wires. In a different embodiment, the cable 14 can include fiber optic lines, either in place of the electrical conductor wires or in addition to the electrical conductor wires. The cable 14 conveys the tool 11 into a wellbore 12.

In the example shown in FIG. 1, the tool 11 is a tool for use in a well. For example, the tool 11 can include a perforating tool or other tool containing explosive devices, such as pipe cutters and the like. In other embodiments, other types of tools can be used for performing other types of operations in a well. For example, such other types of tools include tools for setting packers, opening or closing valves, logging, taking measurements, core sampling, and so forth.

In the example shown in FIG. 1, the tool 11 includes a safety sub 10A and tool subs 10B, 10C, 10D. Although three tool subs 10B, 10C, 10D are depicted in FIG. 1, other implementations can use a different number of tool subs. The safety sub 10A includes a control unit 18A, and the tool subs 10B, 10C, 10D include control units 18B, 18C, 18D, respectively. Each of the tool subs 10B, 10C, 10D can be a perforating gun, in one example implementation. Alternatively, the tool subs 10B, 10C, 10D can be different types of devices that include explosive devices.

The control units 18A, 18B, 18C, 18D are coupled to switches 24A, 24B, 24C, 24D, respectively, and 28A, 28B, 28C, 28D, respectively. The switches 28A-28D are cable switches that are controllable by the control units 18A-18D, respectively, between on and off positions to enable or disable electrical current flow through portions of the cable 14. When the switch 28 is off (also referred to as "open"), then the portion of the cable 14 below the switch 24 is isolated from the portion of the cable 14 above the switch 24. The switches 24A-24D are initiator switches.

Although reference is made primarily to electrical switches in the embodiments described, it is noted that optical switches can be substituted for such electrical switches in other embodiments.

In the safety sub 10A, the initiator switch 24A is not connected to a detonating device or initiator. However, in the tool subs 10B, 10C, 10D, the initiator switches 24B, 24C, 24D are connected to respective detonating devices or initiators 26. If activated to an on (also referred to as "closed") position, an initiator switch 24 allows electrical current to flow to a coupled detonating device or initiator 26 to activate the detonating device. The detonating devices or initiators 26 are ballistically coupled to explosive devices, such as shaped charges or other explosives, to perform perforating or another downhole operation. In the ensuing discussion, the terms "detonating device" and "initiator" are used interchangeably.

As noted above, the safety sub 10A provides a convenient mechanism for connecting the tool 11 to the cable 14. This is because the safety sub 10A does not include a detonating device 26 or any other explosive, and thus does not pose a safety hazard. The switch 28A of the safety sub 10A is initially in the open position, so that all guns of the tool 11 are electrically isolated from the cable 14 by the safety sub 10A. Because of this feature, electrically arming of the tool 11 does not occur until the tool 11 is positioned downhole and the switch 28A is closed. In the electrical context, the safety sub 10A can provide electrical isolation to prevent arming of the tool 11.

Another feature allowed by the safety sub 10A is that the tool subs 10B, 10C, 10D (such as guns) can be pre-armed (by connecting each detonating device 26) during transport or other handling of the tool 11. Thus, even though the tool 11 is transported ballistically armed, the open switch 28A of the safety sub 10A electrically isolates the tool subs 10B, 10C, 10D from any activation signal during transport or other handling.

The safety sub 10A differs from the tool subs 10B, 10C, 10D in that the safety sub 10A does not include explosive devices that are present in the tool subs 10B, 10C, 10D. The safety sub 10A is thus effectively a "dummy assembly." A dummy assembly is a sub that mimics other tool subs but does not include an explosive.

The safety sub 10A serves one of several purposes, including providing a quick connection of the tool 11 to the cable 14. Additionally, the safety sub 10A allows arming of the tool 11 downhole instead of the surface. Because the safety sub 10A does not include explosive devices, it provides isolation (electrical) between the cable 14 and the tool subs 10B, 10C, 10D so that activation (electrical) of the tool subs 10B, 10C, 10D is disabled until the safety sub 10A has been activated to close an electrical connection.

The safety sub 10A effectively isolates "signaling" on the cable 14 from the tool subs 10B, 10C, 10D until the safety sub 10A has been activated. "Signaling" refers to power and/or control signals (electrical) on the cable 14.

In accordance with some embodiments of the invention, the control units 18A-18D are able to communicate over the cable 14 with a controller 17 in the surface unit 16. For example, the controller 17 can be a computer or other control module.

Each control unit 18A-18D includes a microprocessor that is capable of performing bi-directional communication with the controller 17 in the surface unit 16. The microprocessor (in combination with other isolation circuitry in each control unit 18) enables isolation of signaling (power and/or control signals) on the cable 14 from the detonating device 26 associated with the control unit 18. Before signaling on the cable 14 can be connected (electrically) to the detonating device 26, the microprocessor has to first establish bi-directional communication with the controller 17 in the surface unit 16.

The bi-directional communication can be coded communication, in which messages are encoded using a predetermined coding algorithm. Coding the messages exchanged between the surface controller 17 and the microprocessors in the control units 18 provides another layer of security to prevent inadvertent activation of explosive devices.

Also, the microprocessor 100 can be programmed to accept only signaling of a predetermined communication protocol such that signaling that does not conform to such a communication protocol would not cause the microprocessor 100 to issue a command to activate the detonating device 26.

Moreover, according to some embodiments, the microprocessor in each control unit is assigned a unique identifier. In one embodiment, the unique identifier is pre-programmed before deployment of the tool into the wellbore 12. Pre-programming entails writing the unique identifier into non-volatile memory accessible by the microprocessor. The non-volatile memory can either be in the microprocessor itself or external to the microprocessor. Pre-programming the microprocessors with unique identifiers provides the benefit of not having to perform programming after deployment of the tool 11 into the wellbore 12.

In a different embodiment, the identifiers can be dynamically assigned to the microprocessors. For example, after deployment of the tool 11 into the wellbore 12, the surface controller 12 can send assignment messages over the cable 14 to the control units such that unique identifiers are written to storage locations accessible by the microprocessors.

Figure 2:
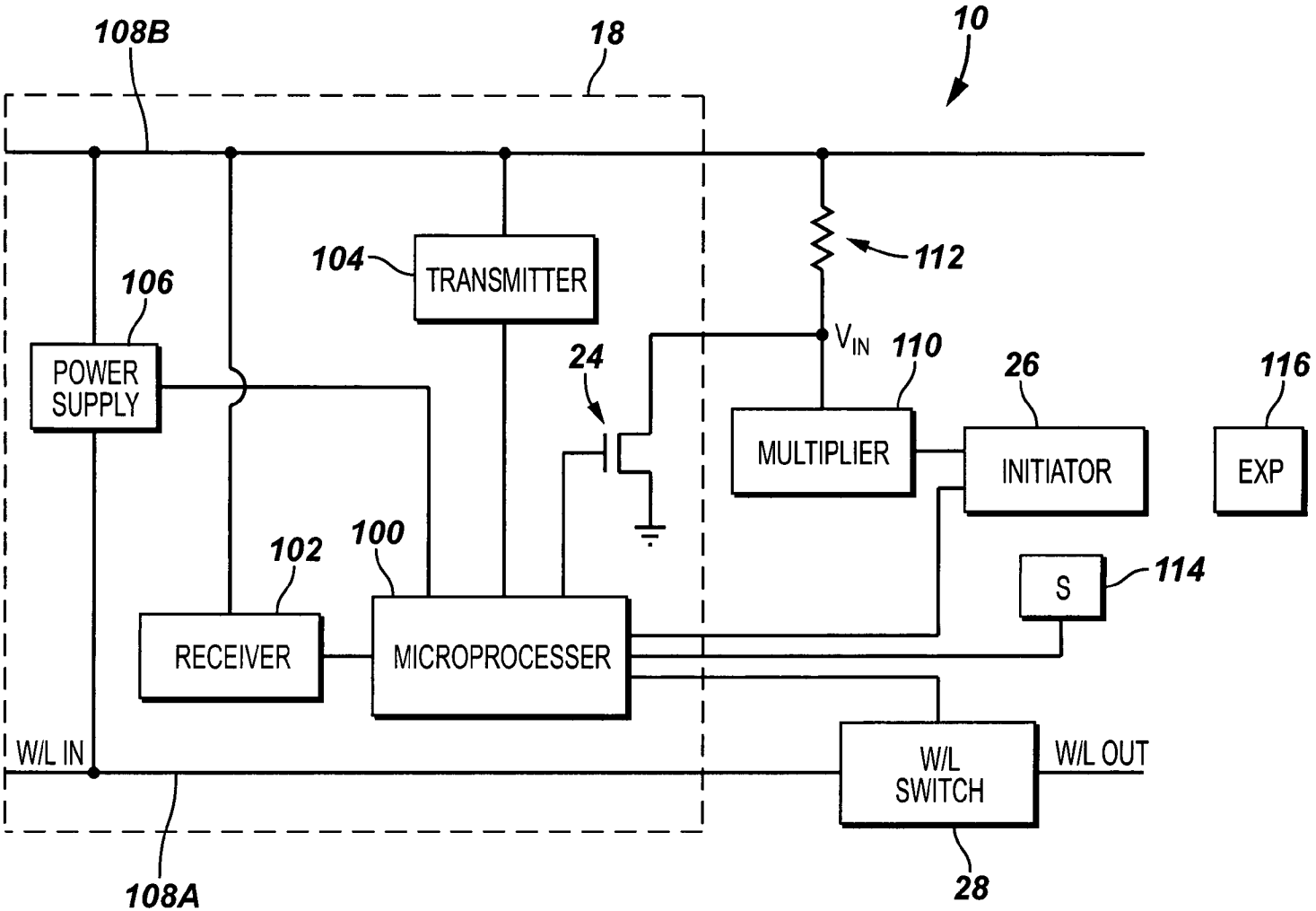
FIG. 2 is a block diagram of a control unit used in the well tool of FIG. 1, according to one embodiment.

FIG. 2 shows a sub in greater detail. Note that the sub 10 depicted in FIG. 2 includes a detonating device 26; therefore, the sub 10 depicted in FIG. 2 is one of the tool subs 10B, 10C, and 10D. However, if the sub 10 is a safety sub, then the detonating device 26 would either be omitted or replaced with a dummy device (without an explosive).

The control unit 18 includes a microprocessor 100 (the microprocessor discussed above), a transmitter 104, and a receiver 102. Power to the control unit 18 is provided by a power supply 106. The power supply 106 outputs supply voltages to the various components of the control unit 18. The cable 14 (FIG. 1) is made up of two wires 108A, 108B. The wire 108A is connected to the cable switch 28. In a different embodiment, the power supply 106 can be omitted, with power supplied from the well surface.

When transmitting, the transmitter 104 modulates signals over the wire 108B to carry desired messages to the well surface or to another component. The receiver 102 also receives signaling over the wire 108B.

The microprocessor 100 can be a general purpose, programmable integrated circuit (IC) microprocessor, an application-specific integrated circuit, a programmable gate array or other similar control device. As noted above, the microprocessor 100 is assigned and identified with a unique identifier, such as an address, a numerical identifier, and so forth. Using such identifiers allows commands to be sent to a microprocessor 100 within a specific control unit 18 selected from among the plurality of control units 18. In this manner, selective operation of a selected one of the control units 18 is possible.

The receiver 102 receives signals from surface components, where such signals can be in the form of frequency shift keying (FSK) signals. The received signals are sent to the microprocessor 100 for processing. The receiver 100 may, in one embodiment, include a capacitor coupled to the wireline 108B of the cable 14. Before sending a received signal to the microprocessor 100, the receiver 102 may translate the signal to a transistor-transistor logic (TTL) output signal or other appropriate output signal that can be detected by the microprocessor 100.

The transmitter 100 transmits signals generated by the microprocessor 100 to surface components. Such signals may, for example, be in the form of current pulses (e.g., 10 milliamp current pulses). The receiver 102 and transmitter 104 allow bi-directional communication between the surface and the downhole components.

The initiator switch 24 depicted in FIG. 1 can be connected to a multiplier 110, as depicted in FIG. 2. The initiator switch 24, in the embodiment of FIG. 2, is implemented as a field effect transistor (FET). The gate of the FET 24 is connected to an output signal of the microprocessor 100. When the gate of the FET 24 is high, the FET 24 pulls an input voltage Vin to the multiplier 110 to a low state to disable the multiplier 110. Alternatively, when the gate of the FET 24 is low, the input voltage Vin is unimpeded, thereby allowing the multiplier to operate. A resistor or resistors 112 is connected between Vin and the electrical wire 108B of the cable 14. In a different embodiment, instead of using the FET, other types of switch devices can be used for the switch 24.

The multiplier 110 is a charge pump that takes the input voltage Vin and steps it up to a higher voltage in general by pulsing the receied voltage into a ladder multiplier. The higher voltage is used by the initiator 26. In one embodiment, the multiplier 24 includes diodes and capacitors. The circuit uses cascading elements to increase the voltage. The voltage, for example, can be increased to four times its input value.

Initially, before activation, the input Vin to the multiplier 24 is grounded by the switch 24 such that no voltage transmission is possible through the multiplier 110. To enable the multiplier 110, the microprocessor 100 sends an activation signal to the switch 24 to change the state of the switch 24 from the on state to the off state, which allows the multiplier to process the voltage Vin. In other embodiments, the multiplier 110 can be omitted, with a sufficient voltage level provided from the well surface.

The initiator 26 accumulates energy from the voltage generated by the multiplier 110. Such energy may be accumulated and stored, for example, in a capacitor, although other energy sources can be used in other embodiments. In one embodiment, such a capacitor is part of a capacitor discharge unit (CDU), which delivers stored energy rapidly to an ignition source. The ignition source may be an exploding foil initiator (EFI), an exploding bridge wire (EBW), a semiconductor bridge (SCB), or a "hot wire." The ignition source is part of the initiator 26. However, in a different implementation, the ignition source can be part of a separate element. In the case of an EFI, the rapid electrical discharge causes a bridge to rapidly change to a plasma and generate a high pressure gas, thereby causing a "flyer" (e.g., a plastic flyer) to accelerate and impact a secondary explosive 116 to cause detonation thereof.

The sub 10 also includes a sensor 114 (or plural sensors), which is coupled (electrically or optically) to the microprocessor 100. The sensor(s) measure(s) such wellbore environment information or tool information as pressure, temperature, tilt of the tool sub, and so forth. The wellbore environment information or wellbore information is communicated by the microprocessor 100 over the cable 14 to the surface controller 17. This enables the surface controller 17 or well operator to make a decision regarding whether activation of the tool sub should occur. For example, if the wellbore environment is not at the proper pressure or temperature, or the tool is not at the proper tilt or other position, then the surface controller 17 or well operator may decide not to perform activation of the tool sub.

The control unit 18 also incorporates a resistor-capacitor (R-C) circuit that provides radio frequency (RF) protection. The R-C circuit also switches out the capacitor component to allow low-power (e.g., low-signal) communication. Moreover, the low-power communication is enabled by integrating the components of the control unit 18 onto a common support structure to thereby provide a smaller package. The smaller packaging provides low-power operation, as well as safer transportation and operation.

Figure 3:
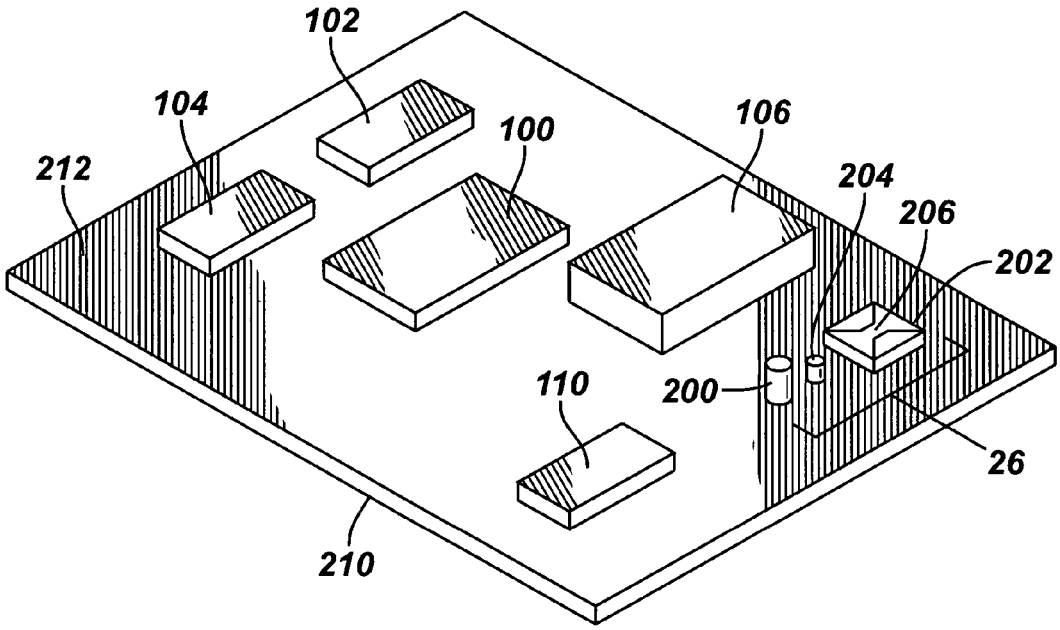
FIG. 3 illustrates an integrated control unit, according to an embodiment.

FIG. 3 shows integration of the various components of the control unit 18, multiplier 110, and initiator 26. The components are mounted on a common support structure 210, which can be implemented as a flex cable or other type of flexible circuit. Alternatively, the common support structure 210 can be a substrate, such as a semiconductor substrate, ceramic substrate, and so forth. Alternatively, the support structure 210 can be a circuit board, such as a printed circuit board. The benefit of mounting the components on the support structure 210 is that a smaller package can be achieved than conventionally possible.

The microprocessor 100, receiver 102, transmitter 104, and power supply 106 are mounted on a surface 212 of the support structure 210. Although not depicted, electrically conductive traces are routed through the common support structure 210 to enable electrical connection between the various components. In an optical implementation, optical links can be provided on or in the support structure 210.

The multiplier 110 is also mounted on the surface 212 of the support structure 210. Also, the components of the initiator 26 are provided on the support structure 210. As depicted, the initiator 26 includes a capacitor 200 (which can be charged to an elevated voltage by the multiplier 110), a switch 204 (which can be implemented as a FET), and an EFI 202. The capacitor 200 is connected to the output of the multiplier 110 such that the multiplier 110 can charge up the capacitor 200 to the elevated voltage. The switch 204 can be activated by the microprocessor 100 to allow the charge from the capacitor 200 to be provided to the EFI 202. The energy routed through a reduced-width region in the EFI 202, which causes a flyer plate to be propelled from the EFI 202. A secondary explosive 116 (FIG. 2) can be positioned proximal the EFI 202 to receive impact of the flyer plate to thereby cause detonation. The secondary explosive can be ballistically coupled to another explosive, such as a shaped charge, or other explosive device.

Figure 4:
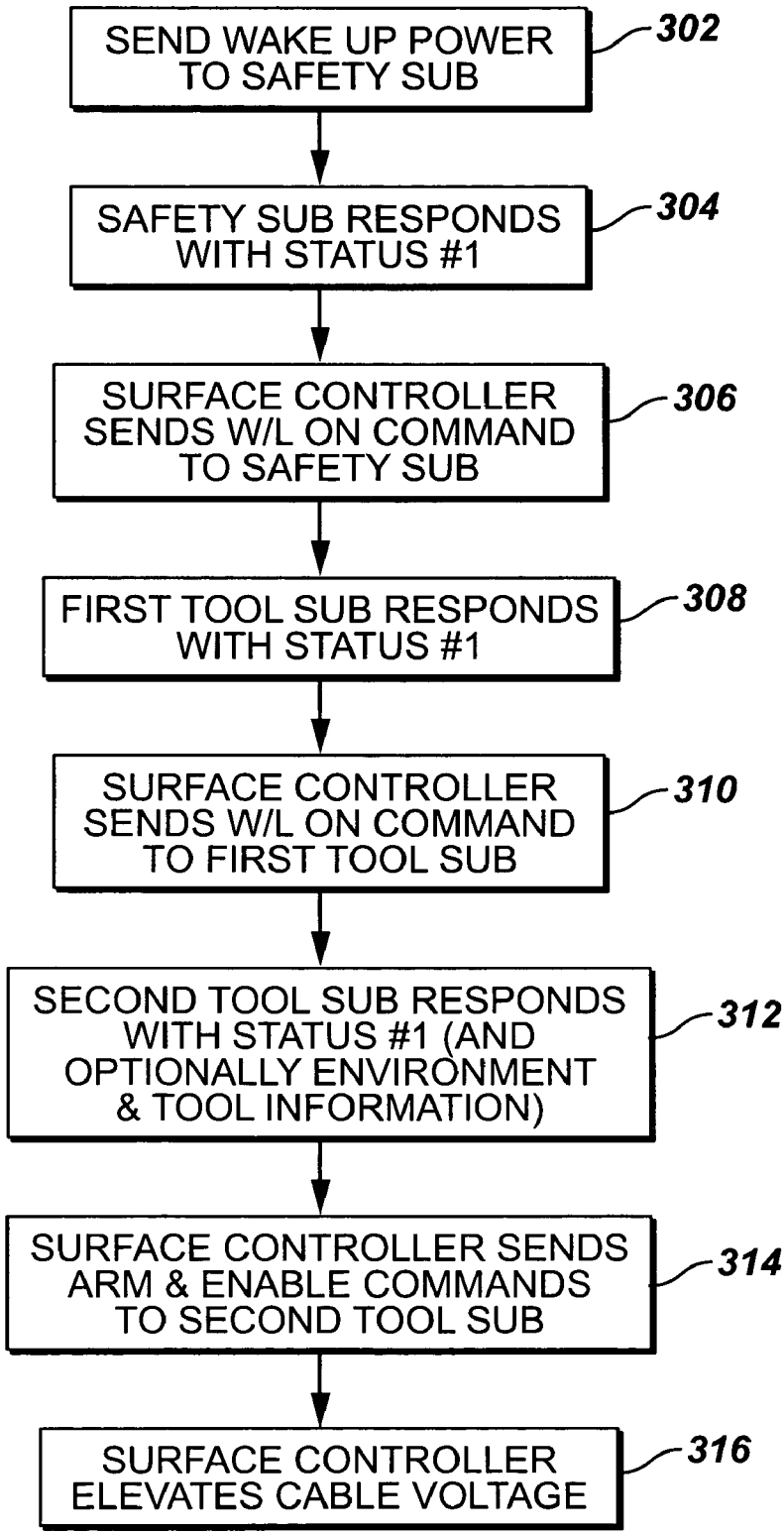
FIG. 4 is a flow diagram of a process of activating the well tool according to an embodiment.

FIG. 4 shows the procedure for firing the tool sub 10C (in the string of subs depicted in FIG. 1). Initially, the surface controller 17 sends (at 302) "wake up" power (e.g., −60 volts DC or VDC) to the uppermost sub (in this case the safety sub 10A). The safety sub 10A receives the power, and responds (at 304) with a predetermined status (e.g., status #1) after some period of delay (e.g., 100 milliseconds or ms).

The surface controller 17 then sends (at 306) a W/L ON command (with a unique identifier associated with the microprocessor of the safety sub 10A) to the safety sub 10A, which causes the microprocessor 100 in the safety sub 10A to turn on cable switch 28A (FIG. 1). The "wake up" power on the cable 14 is now seen by the second tool sub 10B. The tool sub 10B receives the power and responds (at 308) with status #1 after some predetermined delay.

In response to the status #1 message from the tool sub 10B, the surface controller 17 then sends (at 310) a W/L ON command (with a unique identifier associated with the microprocessor of the tool sub 10B) to the tool sub 10B. The "wake up" power is now seen by the second tool sub 10C. The second tool sub 10C responds (at 312) with a status #1 message to the surface controller 17. In response, the surface controller 17 sends (at 314) ARM and ENABLE commands to the tool sub 10C. Note that the ARM and ENABLE commands each includes a unique identifier associated with the microprocessor of the tool sub 10C. The ARM and ENABLE commands cause arming of the control unit 18C by activating appropriate switches (such as turning off the initiator switch 24C). In other embodiments, instead of separate ARM and ENABLE commands, one command can be issued.

The surface controller 17 then increases (at 316) the DC voltage on the cable 14 to a firing level (e.g., 120-350 VDC). The increase in the DC voltage has to occur within a predetermined time period (e.g., 30 seconds), according to one embodiment.

In the procedure above, the second tool sub 10C can also optionally provide environment or tool information to the surface controller 17, in addition to the status #1 message. The surface controller 17 can then use the environment or tool information to make a decision regarding whether to send the ARM and ENABLE commands.

A similar procedure is repeated for activating other tool subs. In this embodiment, it is noted that the surface controller 17 sends separate commands to activate the multiple tool subs.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system comprising:

a well tool for deployment in a well;

a controller;

a link coupled between the controller and the well tool, wherein the well tool comprises plural control units, each of the plural control units having a microprocessor and an initiator coupled to the microprocessor, each microprocessor adapted to communicate bi-directionally with the controller, wherein the controller is adapted to send a plurality of activation commands to respective microprocessors to activate the respective control units, each activation command containing a unique identifier corresponding to a respective control unit, and wherein each control unit includes a circuit board, the corresponding microprocessor and initiator being mounted on one planar surface of the circuit board.

2. The system of claim 1, wherein the initiator includes at least one of an exploding foil initiator, an exploding bridge wire, a hot wire, and a semiconductor bridge.

3. The system of claim 1, wherein the well tool further comprises tool subs, each tool sub comprising a corresponding control unit and an explosive, the explosive to be detonated by the initiator.

4. The system of claim 3, wherein the well tool further comprises a safety sub coupled to the tool subs, the safety sub having identical components as at least one of the tool subs except that the safety sub does not include an explosive, the safety sub to prevent aiming of the tool subs until after activation of the safety sub.

5. The system of claim 3, wherein each of the tool subs comprises a corresponding circuit board.

6. The system of claim 1, wherein the well tool further comprises explosives to be detonated by respective initiators.

7. The system of claim 1, wherein the link comprises a cable, the cable containing a fiber optic line.

8. The system of claim 1, wherein the initiator comprises an exploding foil initiator.

9. A method for use in a wellbore, comprising:

deploying a well tool into the wellbore;

communicating, over a link, between a controller and the well tool, wherein the well tool comprises plural control units, each of the plural control units having a microprocessor and an initiator coupled to the microprocessor;

each microprocessor communicating bi-directionally with the controller, the controller sending a plurality of activation commands to respective microprocessors to activate the respective control units, each activation command containing a unique identifier corresponding to a respective control unit;

providing a circuit board in each control unit; and mounting the microprocessor and initiator of each control unit on a flat surface of the respective circuit board, wherein the flat surface on which the microprocessor and initiator are mounted lies in one plane.

10. The method of claim 9, wherein mounting the initiator on the circuit board comprises mounting at least one of an exploding foil initiator, an exploding bridge wire, a hot wire, and a semiconductor bridge on the support structure.

11. The method of claim 9, wherein the initiator comprises an exploding foil initiator.

12. A method for use in a wellbore, comprising:

deploying a well tool into the wellbore;

communicating, over a link, between a controller and the well tool, wherein the well tool comprises plural control units, each of the plural control units having a microprocessor and an initiator coupled to the microprocessor;

each microprocessor communicating bi-directionally with the controller, the controller sending a plurality of activation commands to respective microprocessors to activate the respective control units, each activation command containing a unique identifier corresponding to a respective control unit;

providing a flexible circuit in each control unit; and mounting the microprocessor and initiator of each control unit on one planar surface of corresponding flex circuit.

13. The method of claim 12, wherein the initiator comprises an exploding foil initiator.

14. A tool for use in a wellbore, comprising:

a plurality of control units for communicating over a link with a remote controller, wherein each of the control units includes a microprocessor, wherein each control unit is adapted to communicate bi-directionally with the remote controller;

a plurality of initiators coupled to respective microprocessors; and wherein the control units are associated with unique identifiers, and wherein each microprocessor is responsive to an activation command containing the corresponding unique identifier, wherein each control unit comprises a flexible circuit having one planar surface on which a respective microprocessor and initiator are mounted.

15. The tool of claim 14, further comprising capacitors mounted to respective flexible circuits.

16. The tool of claim 14, wherein the flexible circuits comprise flex cables.

17. The method of claim 14, wherein the initiator comprises an exploding foil initiator.

* * * * *